US005810195A

United States Patent [19]

Sim

[11] Patent Number: 5,810,195

[45] Date of Patent: Sep. 22, 1998

[54] SANITARY CUP WHICH IS INSERTED INTO DRINKING WATER CAN

[76] Inventor: Daeyong Sim, 183-44, Sunam-dong Nam-ku, U1-san, Rep. of Korea

[21] Appl. No.: 926,877

[22] Filed: Sep. 10, 1997

[30] Foreign Application Priority Data

Sep. 13, 1996 [KR] Rep. of Korea ..... 1996-29543

[51] Int. Cl.[6] ..... B65D 25/40

[52] U.S. Cl. ..... 220/674; 220/675; 220/737; 220/738; 220/739; 220/914

[58] Field of Search ..... 220/674, 675, 220/669, 737, 738, 739, 906, 914, 771

[56] References Cited

U.S. PATENT DOCUMENTS

| | | | |
|---|---|---|---|
| 1,262,289 | 4/1918 | Weber | 220/674 |
| 3,563,408 | 2/1971 | Bijvoet | 220/674 |
| 5,174,469 | 12/1992 | Policapelli | 220/674 |
| 5,700,689 | 12/1997 | Wuster | 220/674 |

*Primary Examiner*—Joseph M. Moy
*Attorney, Agent, or Firm*—Notaro & Michalos P.C.

[57] ABSTRACT

A sanitary cup which is inserted into a drinking water can including: a body which is made of a synthetic resin; a plurality of hemisphere type of projections which are formed on the inner and outer surfaces of the body; an inclined portion which is inclined by about 20° on the upper end portion of the body; a first groove which is formed between a cup bottom surface and a bottom surface edge portion; a projection end which is formed on the bottom surface of the inner side of the body; a second groove which is formed between the bottom surface edge portion and the body to form a protrusion portion on the inner side of the body; and a third groove which is formed in the inner side of the bottom surface edge portion, whereby when a reinforcing edge on the top end of the drinking water can is inserted into the third groove, the protrusion portion is elastically inserted into the lower portion of the reinforcing edge.

1 Claim, 4 Drawing Sheets

SANITARY CUP WHICH IS INSERTED INTO DRINKING WATER CAN

BACKGROUND OF THE INVENTION

1. Field of the Invention

The present invention relates to a sanitary cup which is inserted into a drinking water can. More particularly, the present invention relates to a sanitary cup inserted into a drinking water can which can be used if the drinking water(or beer) within the can is to be shared by other persons, preserve an original taste of the drinking water without change by inserting the cup into the upper portion of the can and simultaneously maintain the sanitary state of the drinking water, in the case where the drinking water is left within the can.

2. Discussion of the Prior Art

Generally, under the structure of a conventional drinking can, an opener, which is secured on the top surface of the can, is upwardly bend and then opened, and only if the opener is opened, the opener can not be re-closed. Accordingly, in the case where the drinking water is left within the opened can, there occurs a problem in that there is no method of closing the upper end of the can which is in the opened state.

Therefore, even if the drinking water is left within the can, the drinking water is often poured out from the can, which makes consumption of money unnecessarily increase. Meanwhile, when the drinking water is processed with other wastes, it makes pollution of environments considerably accelerated. Of course, in the case where the drinking water is left within the can or a consumer can not drink the drinking water at a time, it is really possible that the remaining drinking water is shared with any other person. However, in view of a sanitary problem, it is general that the other person is reluctant to drink the remaining drinking water, and if the drinking water is to be shared with other person, the consumer or the other person should prepare an additional cup, at the time of opening the can.

At this time, in the case where the consumer is in the indoor, since the additional cup is prepared in a kitchen, there is no problem in preparing the cup. However, in the case where he is in the outdoor, since the additional cup should be bought, there occurs a problem in sharing the drinking water with other person.

On the other hand, in the case where the drinking water remains within the cup, if the can in which the drinking water remains is left unprocessed, the dust or a harmful insect enters within the can. Moreover, since carbonic acid gas contained in the drinking water is completely emitted, the drinking water loses its original taste and is thus thrown out into the dust box.

If a product or device which is capable of tightly closing the opened portion of the can is presented, the remaining drinking water can be drunk in a sanitary state.

At the time, it is natural that the remaining drinking water be greatly lose the original taste before the opener of the can is opened, but it is evident that the remaining drinking water holds a more good quality of taste, when compared with the remaining drinking water unprocessed, without having any closing device.

Additionally, if the product or device which is capable of tightly closing the opened portion of the can has a function of the cup itself, it makes the convenience of use greatly increase.

With the product or device, if the consumer drinks the drinking water of the cup alone, he can drink a desired amount of the drinking water using the cup. If the drinking water is left within the can, the opened portion of the can is tightly closed by using the cup and the preserved drinking water can be drunk, when necessary. Further, at the time of opening the can, if the consumer is to share the drinking water with other person, the cup of the product or device can be greatly useful.

Moreover, since the dust or the harmful insect is accumulated or exists on the top surface of the can during the distribution process of the conventional drinking water can, it is desirable that the drinking water within the can should be consumed using an additional cup.

SUMMARY OF THE INVENTION

An object of the present invention is to provide a sanitary cup inserted into a drinking water can which can be used if the drinking water(or beer) within the can is to be shared by other persons, preserve an original taste of the drinking water without change by inserting the cup into the upper portion of the can and simultaneously maintain the sanitary state of the drinking water, in the case where the drinking water is left within the can.

To achieve this and other objects according to the present invention, there is provided a sanitary cup which is inserted into a drinking water can including: a body which is made of a synthetic resin; a plurality of hemisphere type of projections which are formed on the inner and outer surfaces of the body; an inclined portion which is inclined by about 20° on the upper end portion of the body; a first groove which is formed between a cup bottom surface and a bottom surface edge portion: a projection end which is formed on the bottom surface of the inner side of the body; a second groove which is formed between the bottom surface edge portion and the body to form a protrusion portion on the inner side of the body; and a third groove which is formed in the inner side of the bottom surface edge portion, whereby when a reinforcing edge on the top end of the drinking water can is inserted into the third groove, the protrusion portion is elastically inserted into the lower portion of the reinforcing edge.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Hereinafter, an explanation on the construction and operational effect of a sanitary cup which is inserted into a drinking water can according to the present invention will be in detail discussed with reference to FIGS. 1 and 2.

Figure 1:
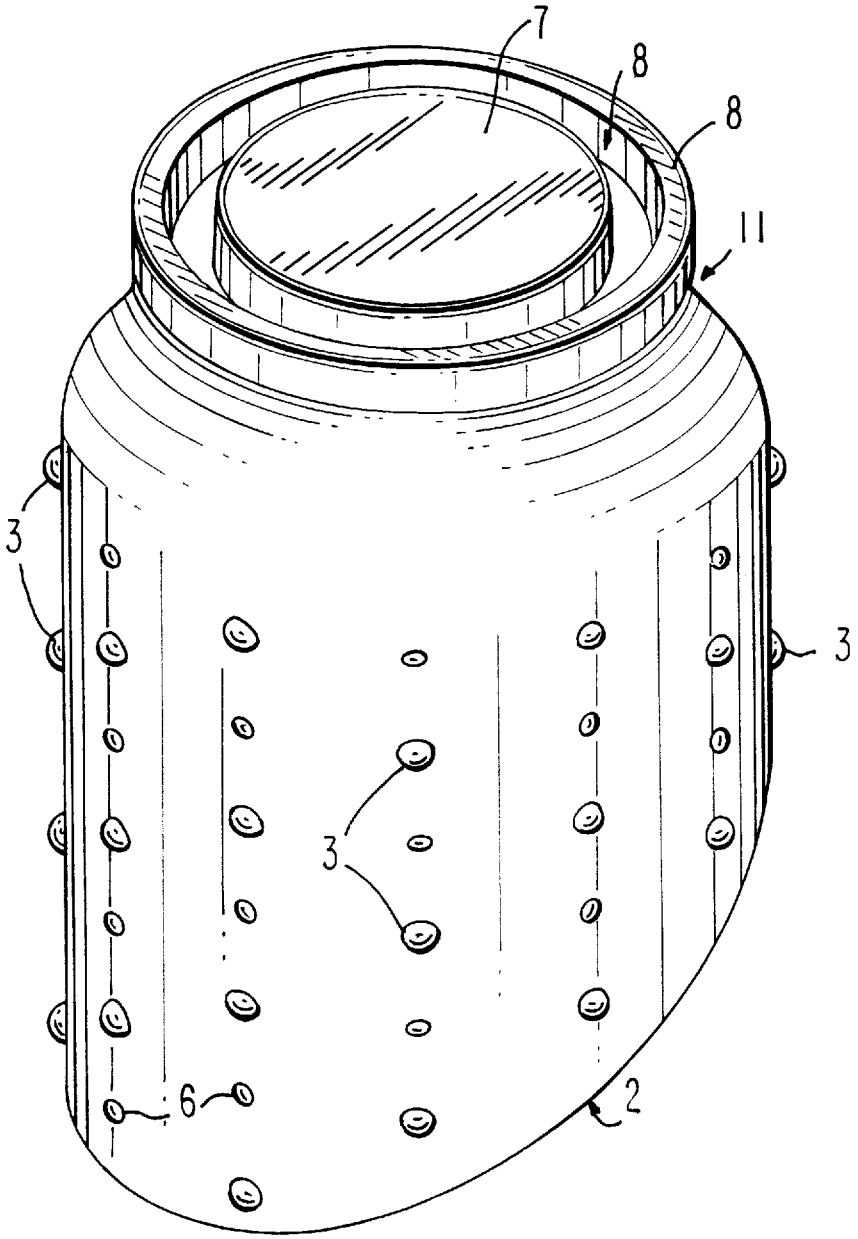
FIG. 1 is a perspective view illustrating an outer appearance of a sanitary cup which is inserted into a drinking water can according to the present invention.
Figure 2:
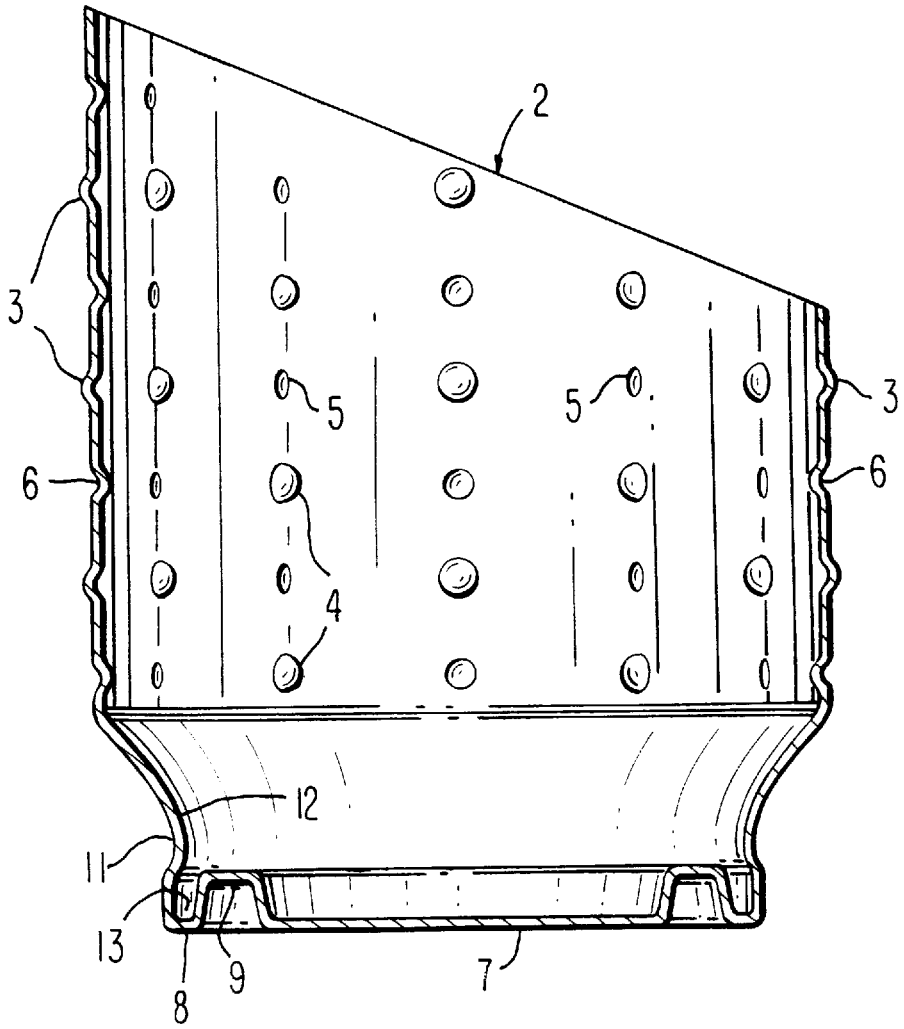
FIG. 2 is a sectional view illustrating a sanitary cup which is inserted into a drinking water can according to the present invention.

Referring to FIGS. 1 to 2, there is provided a sanitary cup which is inserted into a drinking water can according to the present invention, including: a body 1 which is made of a synthetic resin; a plurality of hemisphere type of projections 4 and 3 which are formed on the inner and outer surfaces of the body 1; an inclined portion 2 which is inclined by about 20° on the upper end portion of the body 1; a first groove 9 which is formed between a cup bottom surface 7 and a bottom surface edge portion 8; a projection end 10 which is formed on the bottom surface of the inner side of the body 1; a second groove 11 which is formed between the bottom surface edge portion 8 and the body 1 to form a protrusion portion 12 on the inner side of the body 1; and a third groove 13 which is formed in the inner side of the bottom surface edge portion 8, whereby when a reinforcing edge 102 on the top end of the drinking water can 100 is inserted into the third groove 13, the protrusion portion 12 is elastically inserted into the lower portion of the reinforcing edge 102.

Under the structure of the sanitary cup according to the present invention, the cup is inserted into the upper portion of an opened can and/or a can which is not opened. In other words, the can is inserted into the body of the cup.

Accordingly, when the can 100 is opened or not opened, the sanitary cup according to the present invention can always preserve the top portion 101 of the can in a clean state, and further, a consumer can drink a desired amount of drinking water from the can 100 or share the drinking water with other persons, with the sanitary cup according to the present invention. Moreover, only if the can 100 is opened, the sanitary cup according to the present invention can prevent the remaining drinking water from being in contact with the external air, to thereby preserve an original taste in the remaining drinking water.

Figure 3:
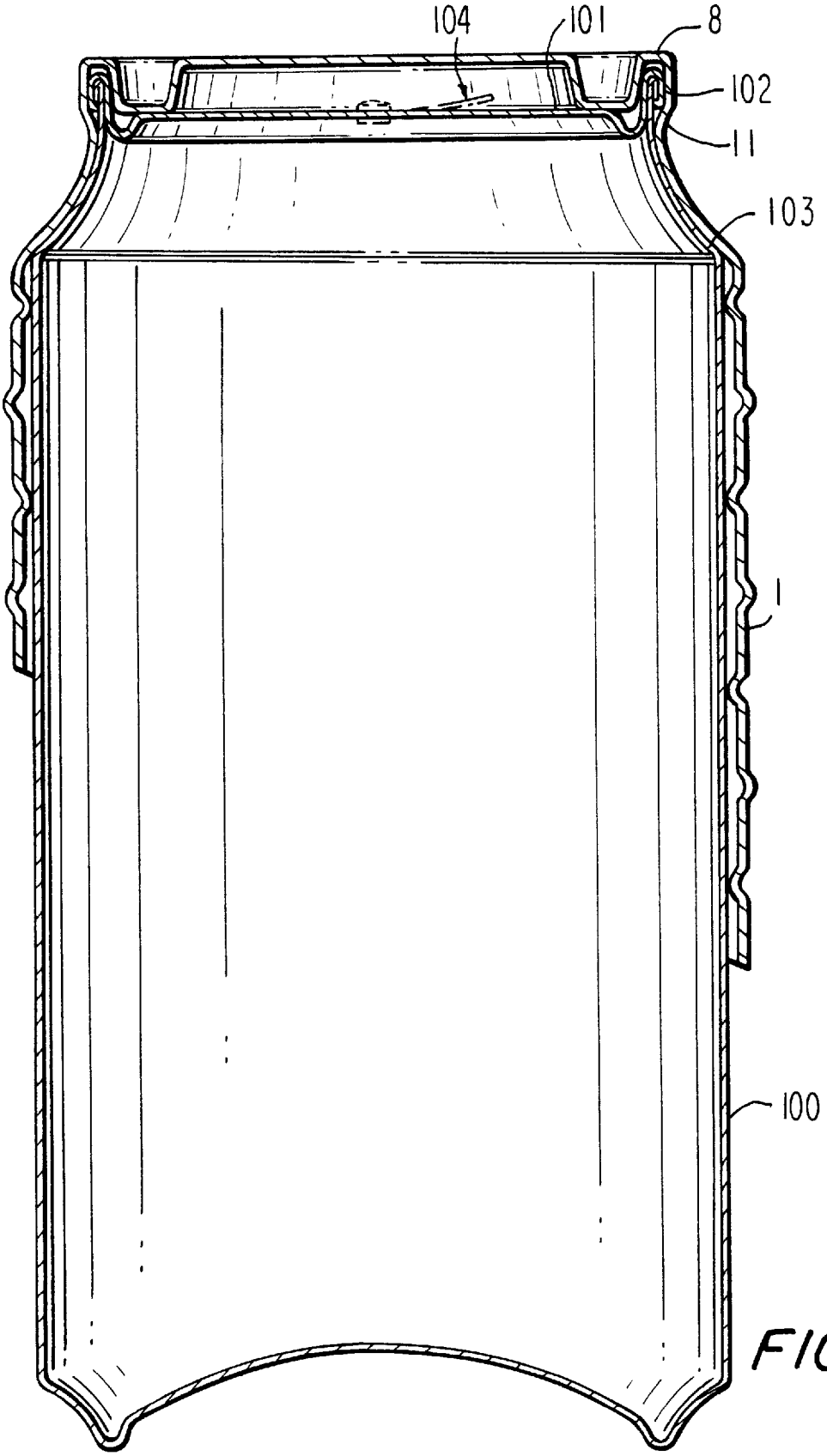
FIG. 3 is a sectional view illustrating a use state of a sanitary cup which is inserted into the drinking water can according to the present invention.

FIG. 3 is a sectional view illustrating a use state of a sanitary cup which is inserted into the drinking water can according to the present invention. In the figure, it can be appreciated that the sanitary cup according to the present invention is inserted into the upper portion of the can 100 which is opened.

The conventional drinking water can 100 is comprised of an opener 104 which is secured on the top portion 101 of the can 100, the reinforcing edge 102 which connects the top surface of the can 100 with the body of can; a groove 103 which is formed between the reinforcing edge 102 and the body of can. The sanitary cup according to the present invention is inserted into the upper portion of the can 100 by using the reinforcing edge 102 and the groove 103 of the can 100.

In more detail, the second groove 11 is formed between the bottom surface edge portion 8 and the body 1 to form the protrusion portion 12 on the inner side of the body 1, and the projection end 10 is formed in the front of the protrusion portion 12. When the reinforcing edge 102 of the upper end of the can 100 is fittingly inserted into the third groove 13 of the inner side of the bottom surface edge portion 8, the reinforcing edge 102 of the can 100 is slid through a narrow space formed between the protrusion portion 12 and the projection end 10 and is then elastically inserted into the third groove 13. At the time, the protrusion portion 12 is elastically inserted into the lower portion of the reinforcing edge 102 which has been inserted into the third groove 13, as if it upwardly supports the reinforcing edge 102. Only if the reinforcing edge 102 of the can 100 which has been inserted into the third groove 13, the reinforcing edge 102 can not be detached from the third groove before it is forcibly detached from the third groove by pulling the body 1. At the time, the reinforcing edge 102 is elastically inserted into the side surface of the projection end 10 and the protrusion portion 12 which constitute the third groove 13. Simultaneously, since the protrusion portion 12 becomes in closely contact with the groove 103 of the can 100, air contact between the interior of the can 100 and the exterior of the body 1 can be prevented.

Accordingly, if the sanitary cup according to the present invention is inserted into the can 100, the remaining drinking water can preserve its original taste, but decreases gradually the taste as a predetermined time elapses.

However, if the remaining drinking water is consumed within about one hours, we check that the drinking water can generally preserve the original taste by our experiments.

Since the sanitary cup according to the present invention is inserted into the can which is opened and tightly closes the can from the exterior, the original taste of the remaining drinking water can be possibly preserved and the sanitary state of the can is good, to thereby redrink the remaining drinking water at any time. Moreover, in the case where the consumer drinks the drinking water or shares it with other person, the sanitary cup is convenient to be use, and if the sanitary cup is distributed, while inserted into the can which is not opened, the upper surface of the can is always maintained in a clean state.

Since the sanitary cup according to the present invention is made of a low-cost of synthetic resin, it can be expected that because the production cost of the cup is low and the sanitary cup is recycled after several uses, a can manufacturer produces the cup which is inserted into his product, without great load, to thereby improve a sale ratio. Further, the sanitary cup according to the present invention can be shipped to the market for sale to a general consumer. Additionally, since the remaining drinking water within the can is not separately poured, there is no inconvenience in treating the can as trash and the pollution of environment caused due to the remaining drinking water of the can can be previously prevented.

Figure 4:
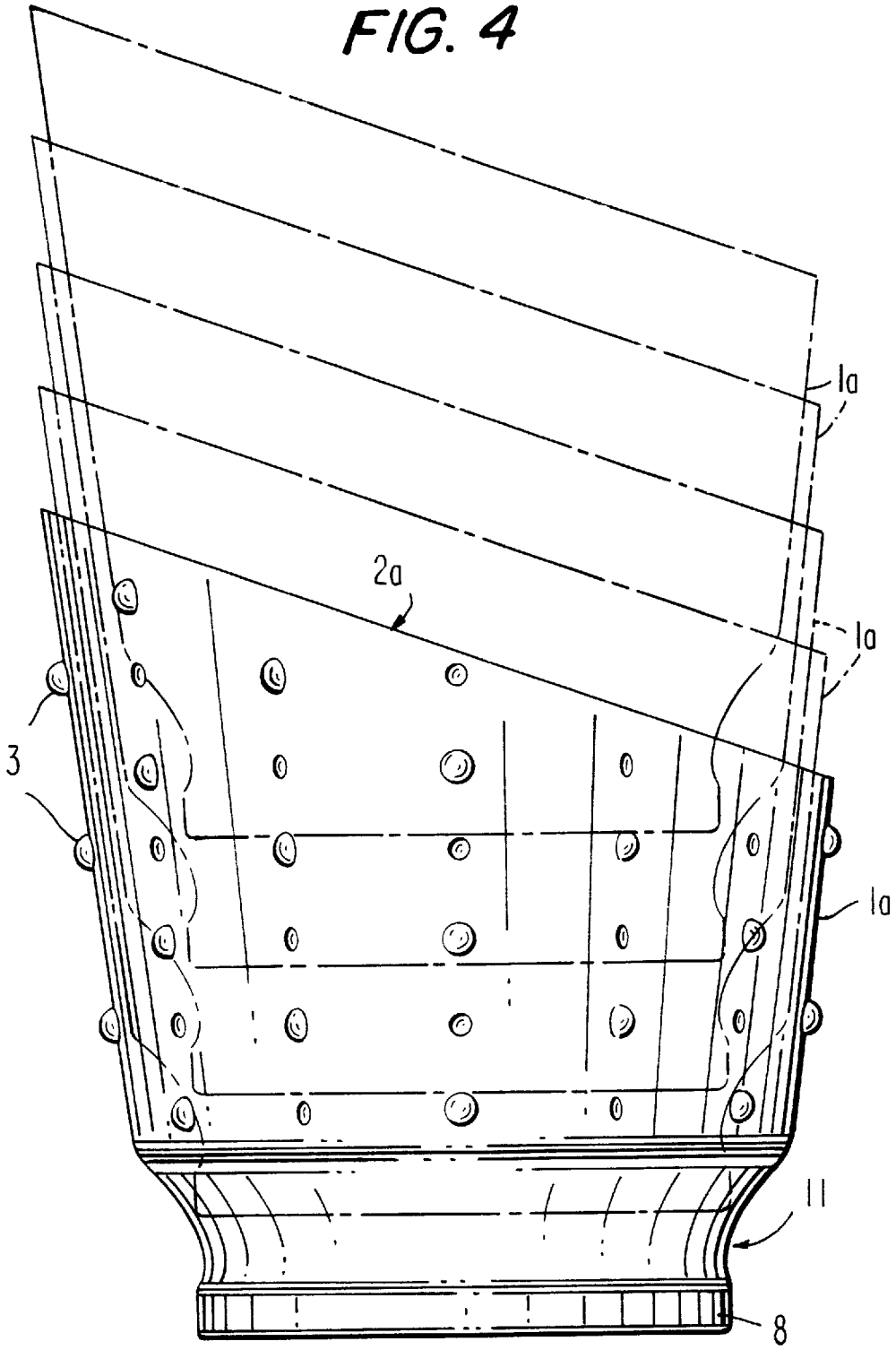
FIG. 4 is a front view illustrating an embodiment of a sanitary cup which is inserted into a drinking water can according to the present invention.

FIG. 4 is a front view illustrating an embodiment of a sanitary cup which is inserted into a drinking water can according to the present invention. A body 1*a* is constructed in such a manner that the length of the upper portion thereof is large and the length of lower portion thereof is small. It is natural that the preferred embodiment of the sanitary cup according to the present invention should be limited within the scope of the present invention. Formation of such type of the body 1*a* provides an advantage of accumulating a plurality of cups as shown in FIG. 4. However, since the upper end portion of the cup is extended from the body of the can, when the cup is inserted into the can, there is a problem that the storing area of the cup is relatively large. Meanwhile, the sanitary cup according to the present invention has the inclined portion 2 which is inclined by about 20° on the upper end portion of the body, such that the drinking water does not flow over the cup, when a consumer pours the drinking water into the cup. Accordingly, since the cloth or other materials due to the drinking water flowing over the cup can be prevented from being wet, it is convenient for the old and the weak, or children to use the sanitary cup according to the present invent ion.

In addition, since the plurality of hemisphere type of projections 4 and 3 which are formed on the inner and outer surfaces of the body 1 are adapted to prevent the cup from being slid, it is accordingly convenient for the old and the weak, or children to use the sanitary cup according to the present invent ion.

It is desirable that the sanitary cup according to the present invention maintains half the height of the conventional can, in view of appearance.

Although a preferred form of the invention has been described, it will be understood by those skilled in the field that variations therefrom, and analogous uses, are within the knowledge of those skilled in the art. Accordingly, it is intended that the scope of the invention be defined, not by the scope of the foregoing description, but rather by the scope of the claims as interpreted in view of the pertinent prior art.

What is claimed is:

1. A sanitary cup which is inserted into a drinking water can, comprising:

a body made of a synthetic resin;

a plurality of hemisphere type of projections formed on the inner and outer surfaces of said body;

an inclined portion inclined by about 20° on the upper end portion of said body;

a first groove formed between a cup bottom surface and a bottom surface edge portion;

a projection end formed on the bottom surface of the inner side of said body;

a second groove which is formed between said bottom surface edge portion and said body to form a protrusion portion on the inner side of said body; and a third groove which is formed in the inner side of said bottom surface edge portion, whereby when a reinforcing edge on the top end of said drinking water can is inserted into said third groove, said protrusion portion is elastically inserted into the lower portion of said reinforcing edge.

* * * * *